US005959519A

United States Patent [19]

Göbel et al.

[11] Patent Number: 5,959,519

[45] Date of Patent: Sep. 28, 1999

[54] ELECTROMAGNETIC SWITCHING DEVICE

[75] Inventors: Ralph-Ronald Göbel; Norbert Sörgel, both of Amberg; Hans Pfab, Hahnbach, all of Germany

[73] Assignee: Siemens AG, Munich, Germany

[21] Appl. No.: 09/125,941

[22] PCT Filed: Feb. 24, 1997

[86] PCT No.: PCT/DE97/00331

§ 371 Date: Aug. 28, 1998

§ 102(e) Date: Aug. 28, 1998

[87] PCT Pub. No.: WO97/33293

PCT Pub. Date: Sep. 12, 1997

[30] Foreign Application Priority Data

Mar. 6, 1996 [DE] Germany ..... 196 08 729

[51] Int. Cl.[6] ..... H01H 51/22; H01F 7/08

[52] U.S. Cl. ..... 335/179; 335/132; 335/180; 335/182; 335/183; 335/229; 335/234; 335/78; 335/79; 335/85; 335/230

[58] Field of Search ..... 335/177–184, 335/229–234, 132, 78–86, 281

[56] References Cited

U.S. PATENT DOCUMENTS

| | | | |
|---|---|---|---|
| 3,984,795 | 10/1976 | Gaskill | 335/170 |
| 4,509,026 | 4/1985 | Matsushita | 335/85 |

FOREIGN PATENT DOCUMENTS

| | | |
|---|---|---|
| 0 078 324 | 5/1983 | European Pat. Off. . |
| 0 380 693 | 8/1990 | European Pat. Off. . |
| 1 140 622 | 12/1962 | Germany . |
| 39 32 274 | 4/1990 | Germany . |
| 39 08 319 | 9/1990 | Germany . |

*Primary Examiner*—Michael L. Gellner
*Assistant Examiner*—Raymond Barrera
*Attorney, Agent, or Firm*—Kenyon & Kenyon

[57] ABSTRACT

A switch device including an inner yoke and an outer yoke are arranged around the winding of an electromagnetic block, and a plate-shaped permanent magnet is inserted between the two yokes. A highly efficient actuation of the switching device is achieved by the assistance of the permanent magnet.

3 Claims, 5 Drawing Sheets

ELECTROMAGNETIC SWITCHING DEVICE

A conventional device is described in German Application No. DE 39 08 319 A1. There, the outer yoke is constructed in a U-shaped fashion. It is situated opposite the other end of the plunger core part in such a way that it is situated at right angles to and adjacent to the latter. A magnetic cylinder is inserted into the axially extending opening of the coil former; a consequence of this design is reduced attractive forces during the winding de-energization. At the same time, the attractive forces are increased during the winding energization with the nominal current, a highly efficient actuation being achieved as a result.

An electromagnetic switching device having an electromagnetic block is also described in U.S. Pat. No. 4,509,026.

Here, the electromagnetic block comprises an armature which has a plunger core, as well as two armature plates which are fastened to the two ends of the plunger core. Also belonging to the electromagnetic block are a winding which is wound around the plunger core of the armature, inner yokes which are arranged at the circumference of the winding and between the two armature plates, and outer yokes which are arranged outside the inner yoke. Permanent magnets are inserted between the inner and the outer yokes. The core is moved in this case between a front position and a rear position, it being retained by the inner and outer yokes when the winding is energized or de-energized, and a contact maker thereby being actuated in order to make or break a contact. The magnetic flux of the permanent magnets is superimposed on the flux of the winding either positively or negatively in this case. However, in the case of this arrangement interspaces or permanent magnets must always be present in the magnetic flux of the winding.

SUMMARY OF THE INVENTION

The present invention relates to an electromagnetic switching device in which an armature is provided in an electromagnetic block at one end of a plunger core part with an armature plate. A winding is wound around a coil former into whose axial opening the plunger core part of the armature is inserted in an axially displaceable fashion. An inner yoke is arranged around the winding and faces the outer surface of the armature plate of the armature. An outer yoke is arranged in such a way that it is situated opposite the inner yoke, a permanent magnet being inserted between said yokes, and that it faces a part of the inner yoke which is situated opposite the armature plate in order to limit the displacement path of the latter, and movable contacts of a contact block are caused by a coupling device, by means of displacing the armature, to make or break contact with fixed contacts.

It is an object of the present invention to create an electric switching device of the above-mentioned type having a magnetic system, in particular a DC magnetic system with the assistance of a permanent magnet, which efficiently actuates a plurality of break contacts and make contacts in conjunction with a low power loss and low space requirement.

The object is achieved according to the present invention by virtue of the fact that the inner yoke is additionally constructed in such a way that it is situated opposite the other end of the plunger core part in such a way that it is situated at right angles to and adjacent to the latter, and that a magnetic cylinder, which has an axial length which is sufficiently larger than the wall thickness of the yoke at the part thereof which faces this other end of the plunger core part, is inserted into the axially extending opening of the core former, surrounding the other end of the plunger core part in the process, with the result that said cylinder is situated at the level of that part of the inner yoke which faces the outer end of the plunger core part.

A sufficient magnetic permeance relative to the passage of the magnetic force lines between the yoke and the plunger core part is ensured by virtue of the fact that the axial length of the magnetic cylinder is sufficiently greater than the wall thickness of the yoke at the part thereof which faces this other end of the plunger core part. The expression "sufficiently greater" includes the requirement for a sufficient permeance, and is not to be understood as a minimum ratio between the axial length of the magnetic cylinder and the wall thickness of the yoke, since said ratio is also a function of the width of the yoke.

German Patent Application No. DE 39 32 274 describes an arrangement for connecting contact bridge supports and magnet armatures in the case of miniature contact tools, in which an inner yoke has projections for holding a permanent magnet.

1 140 622 a plunger core having a cavity for holding a resetting spring.

DETAILED DESCRIPTION

Figure 1:
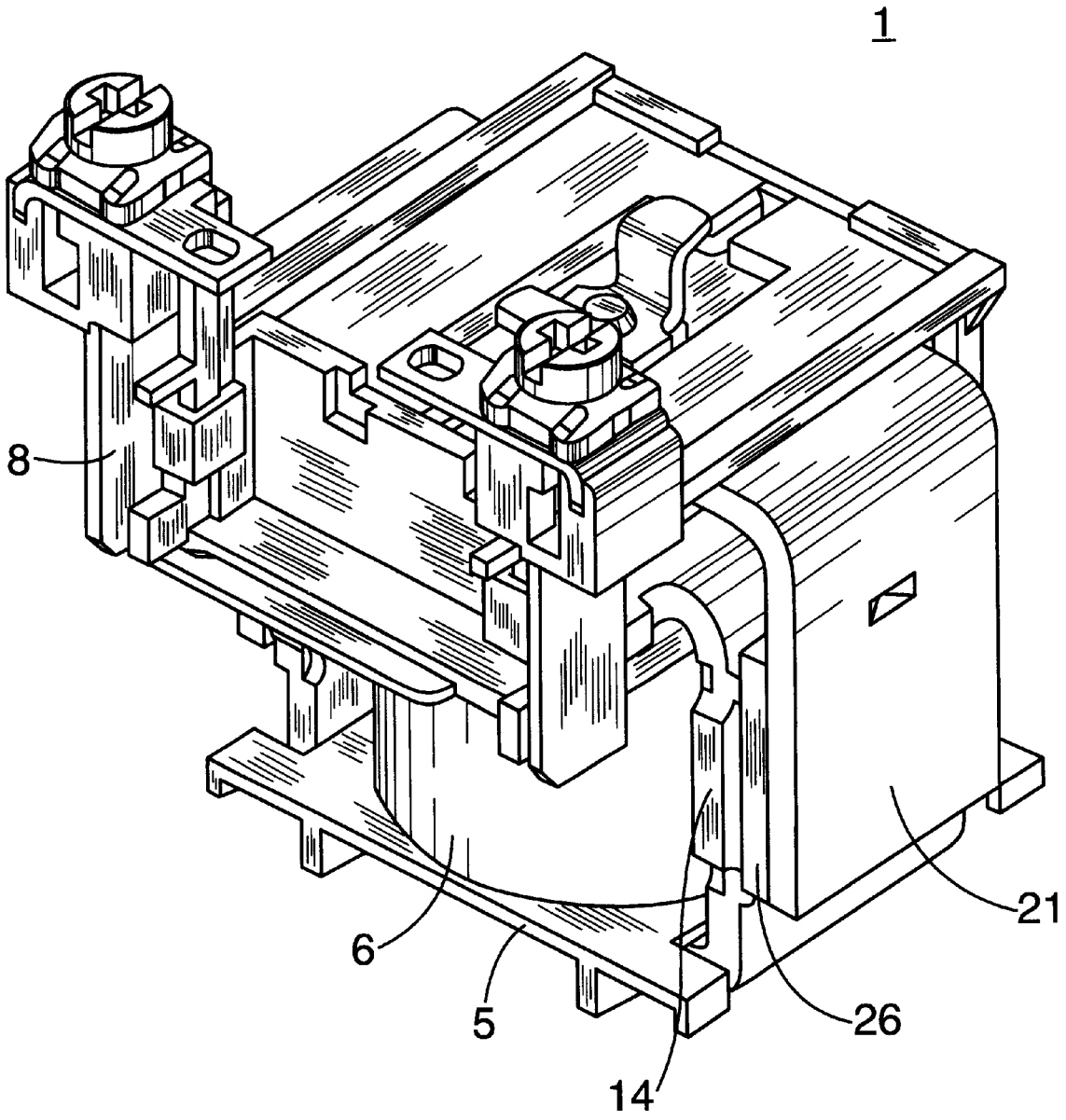
FIG. 1 shows a perspective view of the electromagnetic block in accordance with the present invention, in the assembled state.
Figure 2:
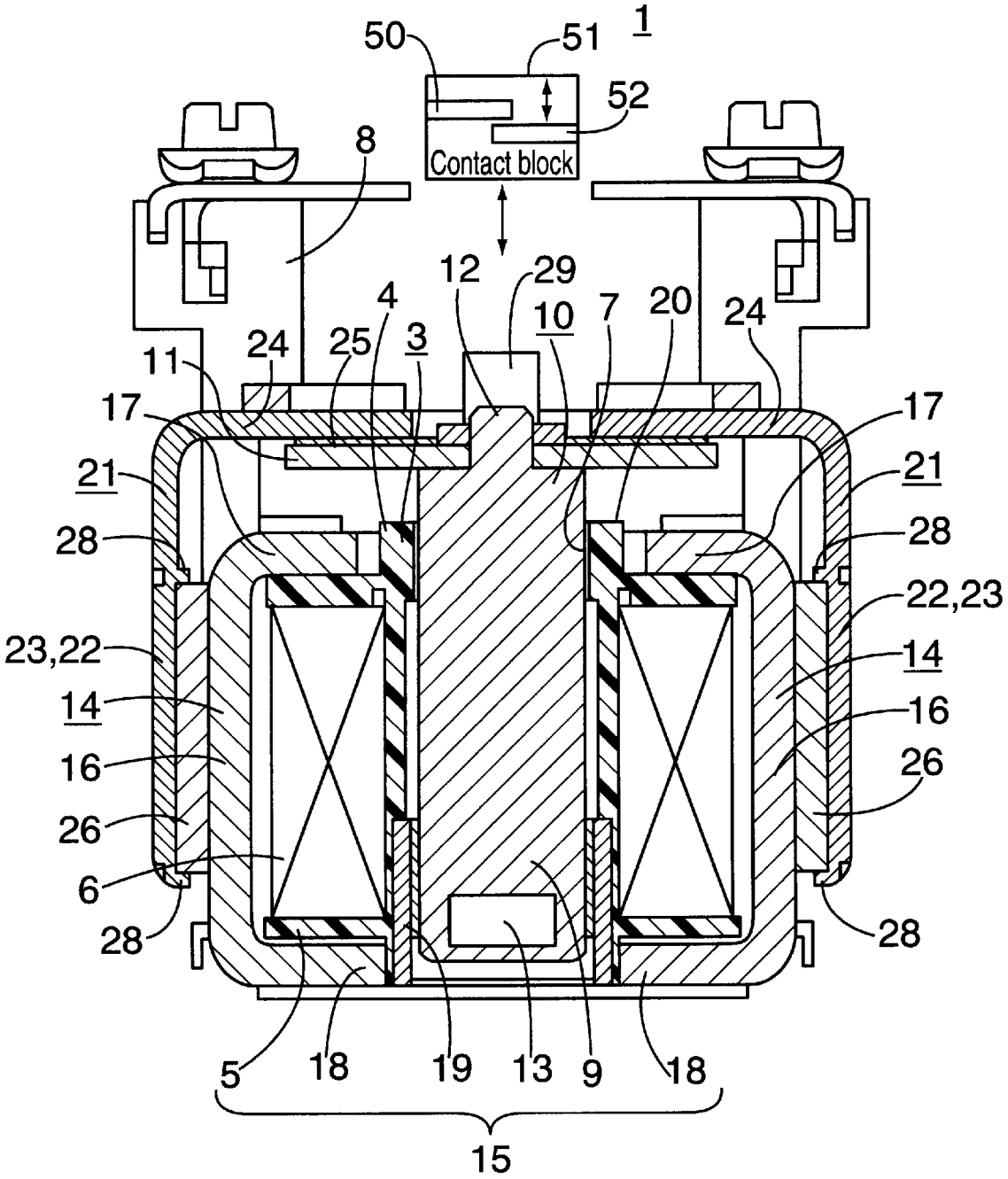
FIG. 2 shows a vertical section through the electromagnetic block according to FIG. 1, in the OFF position.
Figure 3:
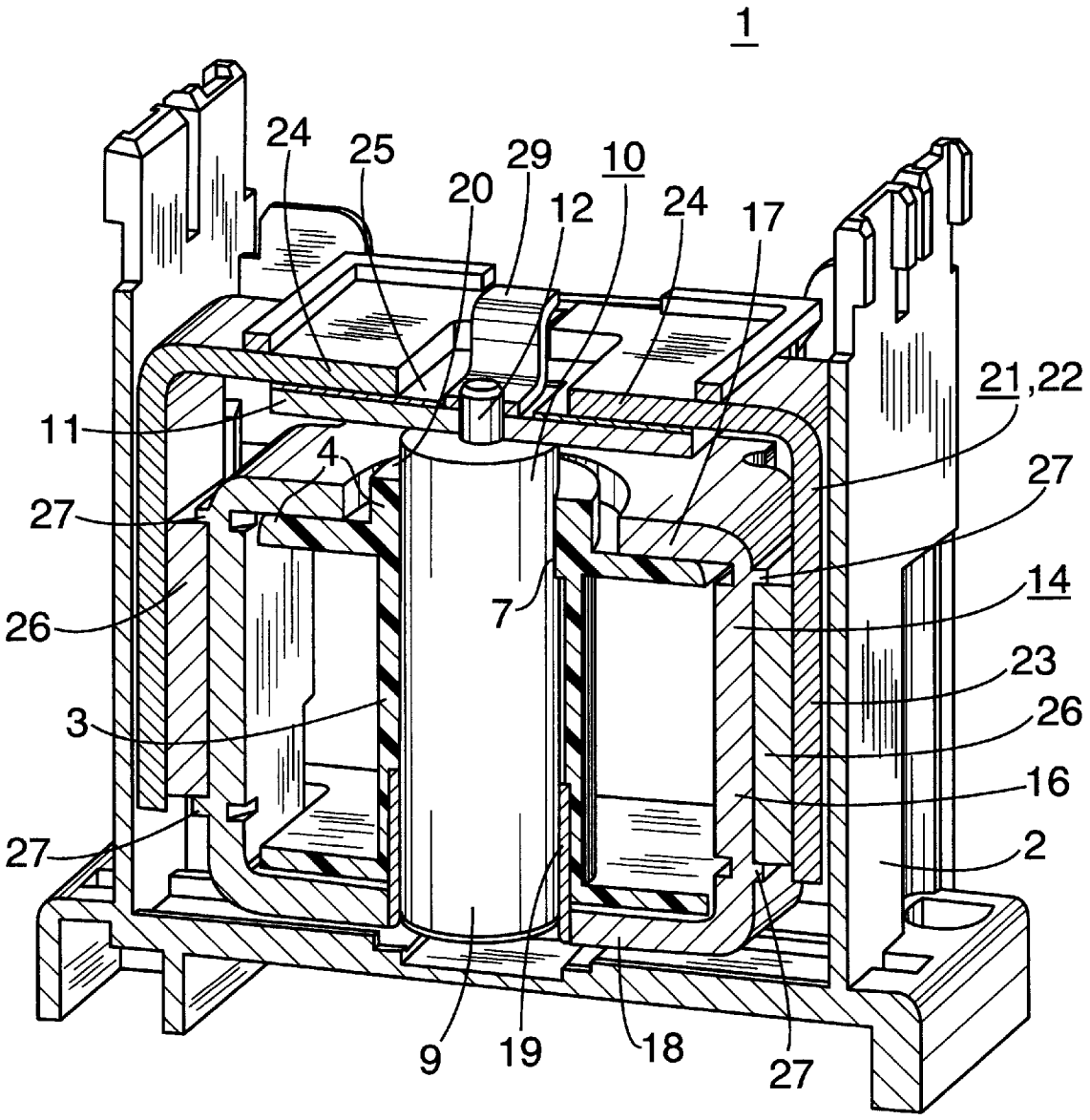
FIG. 3 shows a perspective view of the electromagnetic block in accordance with the present invention after installation in a magnet chamber.
Figure 4:
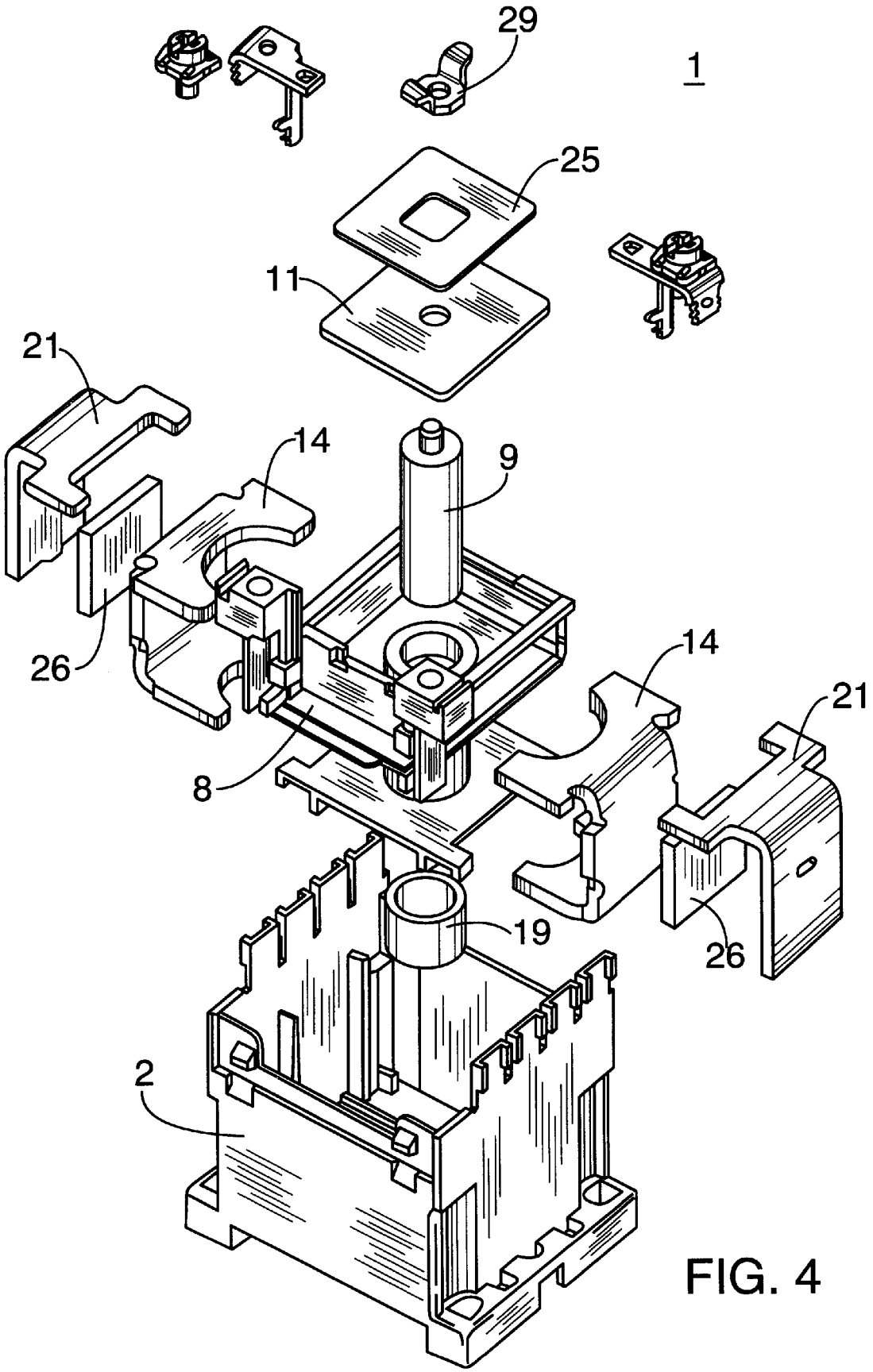
FIG. 4 shows a perspective exploded view of the electromagnetic block having a housing lower part.

The electromagnetic block 1 of a switching device in accordance with the present invention is represented in FIG. 1 to FIG. 5. Said block is arranged in a housing lower part 2, in accordance with FIGS. 3, 4, which is open at the top end in order to mount a contact block 51 which is actuated by the electromagnetic block 1. As shown in FIG. 2, the electro magnetic block 1 comprises a coil winding assembly 3 having an upper flange 4, which faces the contact block, and a lower flange 5, which is averted from said upper flange 4. A winding 6 is wound around the coil winding assembly 3. The coil winding assembly 3 has an axial opening 7, and is part of a coil former 8, to which the connections for the winding 6 are attached. A plunger core part 9 of an armature 10 is displaceably inserted in the axial opening 7. An armature plate 11 is plugged on a cylindrical extension 12 at the upper plunger core part end facing the contact block 51 which includes one or more movable contacts 52. The lower plunger core part end, facing the base of the housing lower part 2, has a cylindrical cutout 13 for holding a press-away spring (not shown) which is supported on the other hand on the housing lower part 2 and holds the contacts 52 of the contact block with respect to one or more fixed contacts 50 in the OFF state in the de-energized state of the electromagnetic block 1. Arranged in each case on mutually opposite sides of the winding 6 and closely adjacent to the latter is a respective U-shaped yoke half 14 of an inner yoke 15. The two yoke halves 14 are formed by a plate-shaped middle part 16 whose ends limbs 17, 18 extend at right angles. In the assembled state in accordance with FIGS. 2, 3, 5, the middle parts 16 extend parallel to the plunger core part 9 between the flanges 4, 5, while the upper limbs 17 facing the contact block bear against the outer surface of the upper flange 4 in a fashion aligned at right angles to the plunger core part 9 and extend approximately up to the cylindrical coil winding assembly 3 with the axial opening 7. Plugged in the latter on the side facing the base of the housing lower part 2 is a magnetic cylinder, constructed here as a bushing 19, which is situated around the plunger core part 9 at a slight spacing and has an overlap which extends beyond the lower flange 5 and is embraced in a self-closed fashion by the lower limbs 18 of the inner yoke halves 14. In the assembled state, the upper limbs 17 are situated closer to the winding 6 than the armature plate 11. The upper flange 4 projects beyond the outer surfaces of the upper limbs 17 and constitutes for the armature plate 11 a stop 20 by means of which a slight interspace is ensured with the armature 10 attracted as shown in FIG. 3.

As shown in FIG. 2, an outer yoke 21 is arranged on the outside around the inner yoke 15, two plate-shaped permanent magnets 26 being pushed between these in such a way that they extend along the middle parts 16. The outer yoke is formed from two L-shaped yoke halves 22 each having a main plate part 23 and a limb part 24, which is angled away at a right angle. The main plate parts 23 are aligned parallel to the plunger core part 9 of the armature 10. The mutually facing limb parts 24 form an opening which serves for guiding through a coupling part 29, fastened to the armature 10, for actuating the contact 51 block. They are situated parallel to the upper limbs 17 of the inner yoke 15, the armature plate 11 being arranged in the interspace between the two. An anti-adhesive plate 25 is fastened to the inner surfaces of the limb parts 24 and has a square cutout for the purpose of connecting the coupling part 29 to the armature 10 and for guiding it through. To fix the permanent magnets 26, in accordance with FIG. 3 or FIG. 2, respectively, the inner yoke 15 or the outer yoke 21 is provided with projections 27 or 28.

Figure 5:
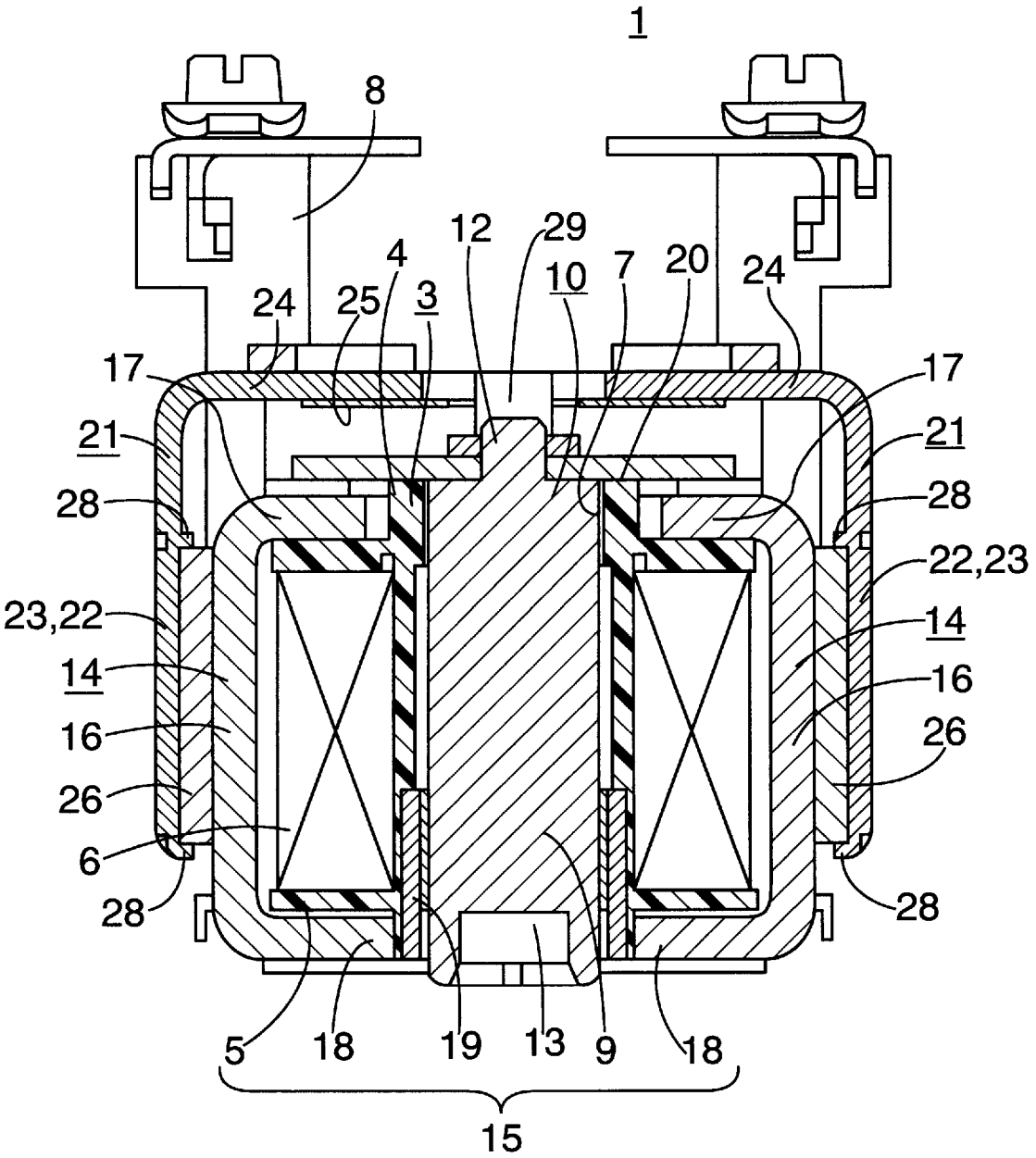
FIG. 5 shows a vertical section through the electromagnetic block according to FIG. 1, in the ON position.

The functioning of the electromagnetic block 1 in accordance with the present invention is to be explained below. As long as the winding 6 is de-energized, the armature plate 11 of the armature 10 bears against the limb regions 24 of the outer yoke 21, the anti-adhesive plate 25 ensuring the required spacing which prevents "adhesion" to the outer yoke 21. In this position, the armature 10 is held via two magnetic circuits (see FIG. 2) which are closed by the plunger core part 9, the armature plate 10, the outer yoke 21, the two permanent magnets 26, the inner yoke 15 and the bushing 19 in said sequence. Upon energization of the winding 6, the armature 10 is attracted in the direction of the housing lower part base 2, the magnetic resistance of the magnetic circuits via which the magnetic flux is formed decreasing as the armature plate 11 approaches the upper limbs 17 of the inner yoke 15, and being associated with an increase in the effect of force on the armature 10 as shown in FIG. 5. A press-away spring (not shown) inserted at the lower plunger core part end 9 is compressed in this process. Said press-away spring serves merely to press the armature 10 into the previous position described above, which produces the OFF state of the contacts, after energization of the winding 6 has been turned off, in which position the actual retention of the armature 10 is then effected by the permanent magnets 26.

What is claimed is:

1. An electromagnetic switching device comprising:

an electromagnetic block;

an armature including a plunger core part which has a first end and a second end;

the armature being provided with an armature plate and being disposed within the electromagnetic block, the armature plate being provided on the first end of the plunger core part;

a coil former having an axial opening, the plunger core part of the armature being axially inserted into the axial opening of the coil former;

a winding wound around the coil former;

an inner yoke arranged around the winding and facing a first side of the armature plate, the inner yoke having a first portion arranged adjacent and perpendicular to the second end of the plunger core part, the first portion of the inner yoke having a wall thickness;

an outer yoke arranged opposite to the inner yoke and having a second portion which faces a second side of the armature plate, the outer yoke limiting a displacement of the armature;

a permanent magnet inserted between the inner yoke and the outer yoke;

a magnetic cylinder having an axial length substantially larger than the wall thickness of the first portion of the inner yoke, the magnetic cylinder being inserted into the axial opening of the coil former and surrounding the second end of the plunger core part, the magnetic cylinder being positioned at a level of the first portion of the inner yoke; and a coupling device arranged adjacent to the armature, a first displacement of the armature causing the coupling device to make a connection between movable contacts of a contact plate and fixed contacts, and a second displacement of the armature causing the coupling device to break the connection between the movable contacts and the fixed contacts.

2. The electromagnetic switching device according to claim 1, wherein the plunger core part includes a cavity for holding a press-away spring.

3. The electromagnetic switching device according to claim 1, wherein the inner yoke includes projections for holding the permanent magnet.

* * * * *